United States Patent [19]

Jones et al.

[11] Patent Number: 5,014,974

[45] Date of Patent: May 14, 1991

[54] IN-LINE, CONTINUOUS PAPER BATCHING SYSTEM

[75] Inventors: Donald A. Jones; Robert M. Jones, both of Terre Haute, Ind.

[73] Assignee: Numerical Concepts, Inc., Terre Haute, Ind.

[21] Appl. No.: 464,970

[22] Filed: Jan. 16, 1990

[51] Int. Cl.[5] ..... B65H 29/34

[52] U.S. Cl. ..... 271/189; 271/215; 271/218; 414/790; 414/790.8

[58] Field of Search ..... 271/215, 214, 217, 218, 271/189; 414/790, 790.8

[56] References Cited

U.S. PATENT DOCUMENTS

| | | | |
|---|---|---|---|
| 3,362,707 | 1/1968 | Lauren | 271/218 |
| 3,392,852 | 7/1968 | Tegner | 414/790.8 X |
| 3,543,651 | 12/1970 | Donahue et al. . | |
| 4,130,207 | 12/1978 | Cogswell et al. . | |
| 4,139,191 | 2/1979 | Muller | 271/79 X |
| 4,359,218 | 11/1982 | Karis | 271/218 X |
| 4,541,763 | 9/1985 | Chandhoke et al. . | |
| 4,610,593 | 9/1986 | Voss et al. . | |
| 4,616,815 | 10/1986 | Vijuk . | |
| 4,772,003 | 9/1988 | Nobuta et al. . | |

*Primary Examiner*—H. Grant Skaggs
*Assistant Examiner*—C. Druzbick
*Attorney, Agent, or Firm*—H. John Barnett

[57] ABSTRACT

An apparatus for in-line, high-speed stacking of paper signatures which includes two or more horizontally disposed batch forks having integral, pivoting fingers which project upstream towards an incoming flow of shingles being continuously conveyed from a sheeter. The batch forks are supported on a paper batching carriage, and can be raised and lowered from a pivot point, and retracted to transfer a partial stack of shingles to intermediate interrupt forks or to main pile forks for transfer to a conveyor. These additional paper handling forks cooperate with the batch forks and integral, pivoting fingers to continuously stack the shingled sheets in quantities determined by a counting and control system. The pivoting fingers depress the incoming signatures to separate them into stacks without slowing flow from a present rate of about 1200–1300 f.p.m. and higher.

10 Claims, 3 Drawing Sheets

IN-LINE, CONTINUOUS PAPER BATCHING SYSTEM

BACKGROUND OF THE INVENTION a. Field of the Invention

This invention is directed to an apparatus for in-line, continuous stacking of paper signatures. Two or more horizontally disposed batch forks include integral, pivoting fingers which separate the incoming shingles by depressing the leading edge of the last shingle in the batch/stack. The leading edge of the next shingle rides over the top of the integral, pivoting fingers to begin the next batch/stack on the batch forks.

Several different batch/stack handling systems are contemplated, depending on the speed required for the system. In one embodiment, batch/stack handling apparatus is provided so that a partial stack is formed and held while a first stack is being delivered to a downstream conveyor system. When the first stack has been delivered to the conveyor, the handling apparatus returns to its original position to receive the partial stack. When the intermediate stack is completed, it is delivered to the downstream conveyor system. While the intermediate stack is being completed, the intermediate stack forks are returning to their original starting position; the cycle repeats continuously.

In another embodiment in which speed of stacking is not as critical, the intermediate stacking apparatus is eliminated. It is only necessary then to provide means for delivering the upper stack supported on the batch forks, and the lower stack which has been diverted below the batch forks to the downstream conveyor system in an alternating, coordinated flow.

b. Description of the Related Art

There are a number of systems described in the prior art for stacking signatures. U.S. Pat. No. 3,543,651 to Donahue et al describes a machine which inverts the line of incoming shingles and inserts the papers into the bottom of a stack.

The flow of papers is interrupted to form a gap in the line in response to a signal from a photoelectric cell counter. The gap is sensed by a first switch, which then causes the first conveyor to resume operation. When the gap reaches a second switch, a limit stop is activated to release the stack to the conveyor system. The stack then moves over a third switch, causing the limit stop to be extended through the gap to start the next stack. The Donahue et al system is really not continuous, and is not adapted to high speed stacking.

Cogswell et al, U.S. Pat. No. 4,130,207, piles a continuous stream of "booklets", bottom up. At a predetermined stack size, the stack is ejected from the apparatus without stopping delivery of the continuous stream of booklets, which are accumulated in a temporary holding stack. The temporary holding stack is depleted at a rate faster than it is formed, following ejection of the other stack. Cogswell et al is directed to top stacking apparatus, but each booklet is delivered to the stack through the nip between a drive wheel and a weighted wheel which receives the booklets from a conveyor. Ejector fingers transfer the stacked booklets horizontally to a downstream location. It is believed that the stacking speed is limited by the drive wheel stack feeding system, and that a potential for misfeeds to the stack exists as well as clogging of the temporary stack which forms while the first stack is being moved to the downstream stack conveyer, and while the downstream stacker is filling.

Chandhoke et al, U.S. Pat. No. 4,541,763, describes a device for stacking signatures which includes an interceptor for initiating the formation of a stack, and which transfers the partially formed stack from the interceptor to the main member. A "gapper" having a retarder roller assembly separates the successive shingles into predetermined quantities for stacking. The interceptor only responds to a "gap" in the shingles created by the retarder roller assembly, and does not initiate separation of the stacks.

Voss et al, U.S. Pat. No. 4,610,593, describes a conveyor/stacker device which includes an upper and two lower belts. The upper belt can be shifted over to one or the other of the two lower belts to unload and convey a completed stack. Vijuk, U.S. Pat. No. 4,616,515, disclosed an automatic stacking and folding apparatus which receives, stacks and folds shingled sheets from a printing press. The sheets are counted by photocells. The sheets are first automatically aligned, folded and then stacked. The stacking apparatus includes retractable stop fingers 54 (FIG. 15). The stack is built up from the bottom to about 50 signatures, and is then conveyed away by conveyor belts 58. A detailed description appears at Column 9 of the patent specification.

U.S. Pat. No. 4,772,003 issued to Nobuta et al describes a stacking system in which signatures are loaded vertically from above. A laser beam is used to count the signatures, and a dividing plate 39 separates the succeeding stream 20 of signatures at the accumulating plate 41. See Column 12 of the specification and FIGS. 8 and 9 of the patent. The dividing plate appears to have only one function, that is, to hold up the stream 20 until the dividing plate is retracted. The dividing plate does not appear to divert the flow of signatures.

SUMMARY OF THE INVENTION

This invention is directed to a continuous, high speed batching/stacking system in which incoming shingled signatures are batched or stacked on a plurality of main pile forks. When a stack is completed, the incoming signatures are separated by depressing the leading edge of the next incoming shingled signature by means of a plurality of integral, pivoting fingers which extend upstream towards the incoming shingles.

The integral, pivoting fingers are each attached to one of a plurality of batch forks. The pivoting fingers respond to an automatic shingle counter signal to depress the last shingle in a stack. The leading edge of the next shingle rides over the top of the integral, pivoting fingers to begin another stack, while the first stack is delivered to a downstream conveyor.

For higher speed stacking operations (1200–1300 f.p.m.), the system may include intermediate stacking apparatus having a plurality of intermediate interrupt forks to which a partial stack of signatures is transferred from the batch forks while the previous, complete stack is being delivered to the downstream conveyor system. When the main pile forks have returned to their initial stacking position, the partial stack is transferred from the intermediate interrupt forks to the main pile forks. The intermediate interrupt forks withdraw, and the stacking cycle continues as before.

In the high speed stacking system, a stacking cycle commences with all the moving parts in a "home" position. Initially, the shingled signatures are conveyed under the integral, pivoting fingers to begin a first stack on the main pile forks. The main pile forks move downwardly as the stack builds. When the stack count is reached, a solenoid is energized to cause the integral fingers on the batch forks to lower, depressing the leading edge of the last shingle in the main pile fork stack. The leading edge of the next shingle rides over the integral, pivoting fingers to begin an intermediate stack on the batch forks.

When the stack has been almost completed on the main pile forks (except for the last signature), a batch card output is enabled, causing a delay in time sufficient to allow the last signature to arrive fully on the stack before the main pile forks commence the delivery cycle to the downstream conveyor.

As signatures are stacked on the main pile forks, the main pile forks carrying the stack move in a continuous downward motion for delivery of the completed stack to a downstream conveyor belt. The batch carriage is then lowered by a drive means. When the associated solenoid is de-energized, the integral, pivoting fingers return to their initial position. The batch carriage, batch forks and integral, pivoting fingers are then in a position to transfer the partial stack to the intermediate interrupt forks.

When the main pile (first stack) reaches the bottom of its travel, the conveyor starts, and the intermediate interrupt forks receive the partial stack from the batch forks. The batch forks then retract. On signal from the conveyor, the main pile forks return to their original position after transfer of the first stack to the downstream conveyor. The intermediate interrupt forks also return to their original, withdrawn position after transferring the partial stack of signatures to the main pile forks, and the stacking cycle is repeated.

When the stacks are relatively large, and speed is not a main requirement, the intermediate interrupt forks are not required, because the main pile forks can transfer the completed stacks to the conveyor, and then return to their original position to accept the partial stack from the batch forks. This operation eliminates the need for the intermediate transfer of a partial stack.

An important feature of this invention, which makes it adaptable to high-speed stacking, is the employment of integral, pivoting fingers to depress the leading edge of the last shingle in a stack to separate it from successive, continuously moving shingles to start a new stack above the fingers on the batch forks. Another important feature of the high speed embodiment of the new stacker is the inclusion of intermediate interrupt forks for removing a partial stack from the batch forks, and transferring it to the main pile forks.

The combination of parts and their interrelated functions as described herein, provide an in-line continuous high-speed batcher/stacker. The subject batcher/-stacker system is capable of a speed in the order of 1200–1300 f.p.m. and higher.

DETAILED DESCRIPTION

Figure 1:
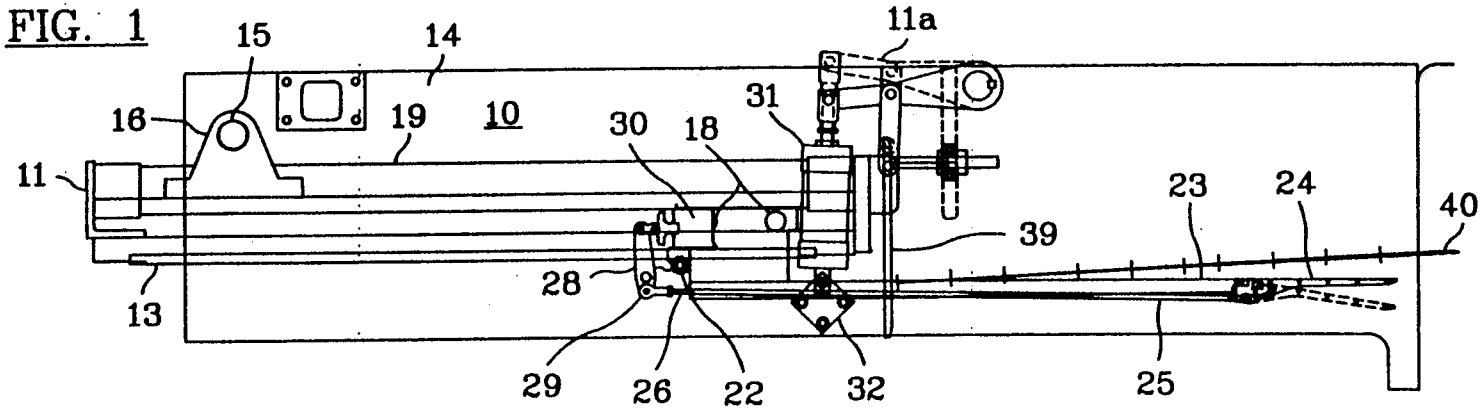
FIG. 1 is a side elevation of the presently preferred embodiment of the invention, but not showing the intermediate interrupt forks or the main pile forks.
Figure 2:
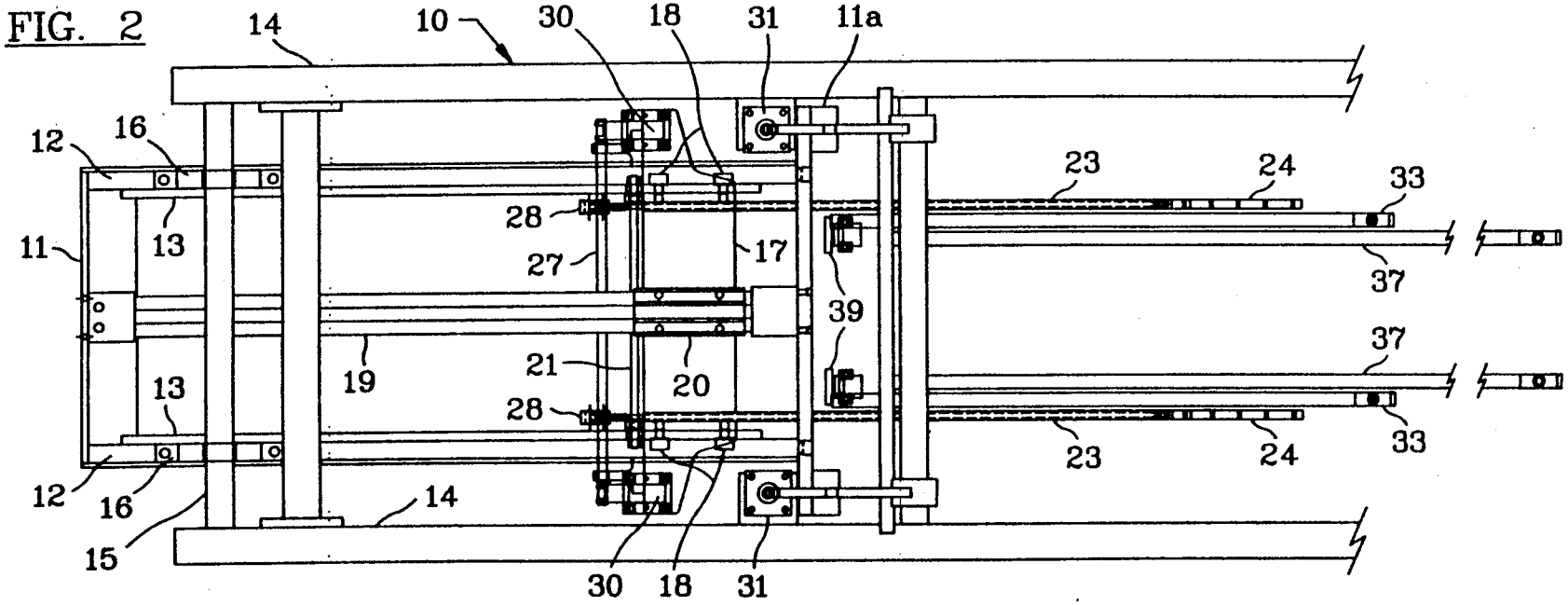
FIG. 2 is a top plan view of the apparatus shown in FIG. 1, and showing the relative positions of the main pile forks, the intermediate interrupt forks and the batch forks, with some parts broken.

As shown in the drawings, a paper batching machine 10 is shown in FIGS. 1 and 2 of the drawings. The machine 10 includes a batch carriage 11 on which is mounted two parallel spacer bars 12 and a stationary gear rack 13 on each side of the centerline of flow. The batch carriage is pivotally connected to frame 14 by means of pivot rod 15 which extends through brackets 16 on batch carriage 11.

Within the batch carriage 11 is a fork mounting plate 17 on the ends of which are attached two cam followers 18. The cam followers 18 ride within the groove provided by the spacer bars 12 thereby supporting the fork mounting plate 17. A rodless air cylinder 19 is attached directly to the batch carriage 11 at both ends, centered horizontally, and the piston mounting lug of said rodless air cylinder 19 is attached to the fork mounting plate 17 by means of a connecting block 20. A gear rod 21 is housed within the fork mounting plate 17. On both ends of said gear rod 21 is mounted a gear 22 to mesh with the stationary gear rack 13 to provide axial stability as the rodless air cylinder 19 extends and retracts.

The batch forks 23 are attached at the downstream ends to the fork mounting plate 17. The upstream ends of the batch forks 23 each terminate in a pivoting, integral finger 24, which includes a pushrod 25 for raising and lowering the integral fingers 24. The downstream ends 26 of pushrods 25 are pivotally attached to torsion rod 27, by means of torsion arms 28, which are attached by linkages 29 to the ends 26 of pushrods 25. Reciprocating solenoids 30, mounted on the batch fork mounting plate 17, connect to pushrods 25 through torsion rod 27 so that operation of solenoids 30 causes the pivoting, integral fingers 24 to be raised or lowered.

A pair of air cylinders 31 are connected at their first ends 32 to frame 14 of the paper batching machine 10, and at their second ends to the batch carriage 11. When air is supplied to operate air cylinders 31, end 11*a* of batch carriage 11 is raised or lowered, along with batch forks 23 and the integral fingers 24 supported thereon, pivoting around pivot rod 15.

Figure 3:
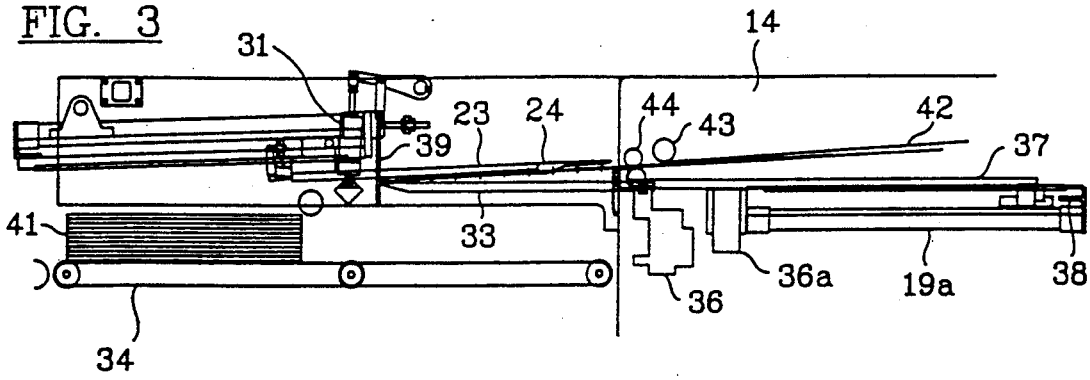
FIG. 3 is a smaller, side elevation of the embodiment shown in FIG. 1, including the intermediate interrupt forks and the main pile forks, and showing the batching system with all parts in the initial (home) position as the batching cycle is about to commence.

As can be seen in FIGS. 2–6, a pair of main pile forks 33 are normally disposed just inwardly from the batch forks 23 and are adapted to move vertically. The main pile forks 33 are initially positioned as shown in FIG. 3 of the drawings, and move downwardly when signatures are stacked on the main pile forks 33. A downstream conveyor 34 is provided for receiving stack 35 of signatures from the main pile forks 33, when main pile forks 33 are lowered below the horizontal level of the downstream conveyor 34.

The main pile forks 33 are supported on frame 14 of paper batching machine 10 by means of a vertically disposed ball nut and screw assembly 36, which is activated on signal to cause the main pile forks 33 to move up or down.

In addition to the batch forks 23 and the main pile forks 33, a pair of intermediate interrupt forks 37 may be provided. The interrupt forks 37 are best seen in FIGS. 2–6.

The intermediate interrupt forks 37 are each supported on an interrupt fork carriage 38 supported on frame 14 of batching machine 10. The interrupt fork carriage 38 includes a rodless air cylinder 19*a* on which forks 37 ride back and forth in-line with the direction of flow of the shingled signatures 40 through the batching machine 10, and a vertically disposed ball nut and screw assembly 36*a* is provided to allow limited up and down motion of the intermediate forks 37.

As best seen in FIG. 1, stripper/front stops 39 are provided to aid in positioning shingled signatures 40 to form a partial stack 46. In addition, stops 39 retain partial stack 46 on the interrupt forks 37 when the batch forks 23 are retracted. Conventional "joggers" are provided to align the signatures 40 laterally during stacking.

The batching operation sequence, using the optional intermediate interrupt forks 37, is best seen in FIGS. 3–6.

Referring first to FIG. 3, a first delivered stack 41 of signatures is shown at the downstream end of downstream conveyor 34, and the main pile forks 33 are shown in position to receive shingled signatures 40 from upstream conveyor 42. The batch forks 23 and their integral fingers 24 are disposed slightly above, and in line with the downstream end of upstream conveyor 42, in proximity to drive rollers 43 and weighted roller 44 of upstream conveyor 42.

Figure 4:
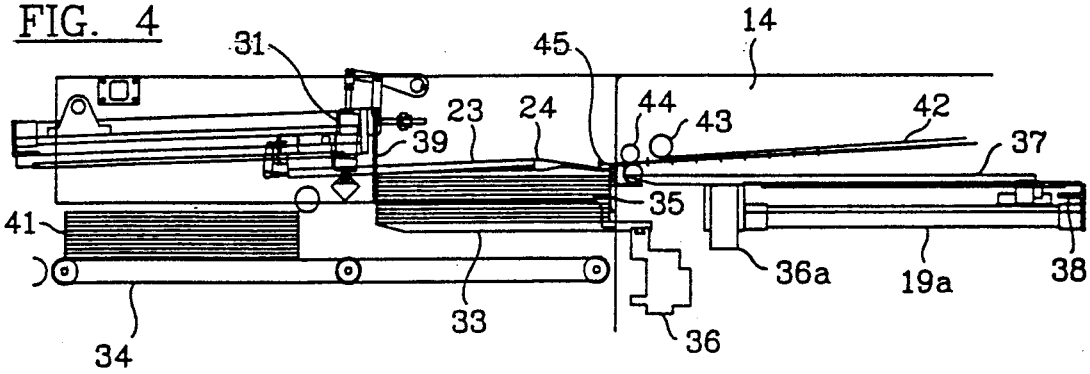
FIG. 4 is similar to FIG. 3, but shows a completed stack of signatures supported on the main pile forks and the integral, pivoting fingers depressed.
Figure 5:
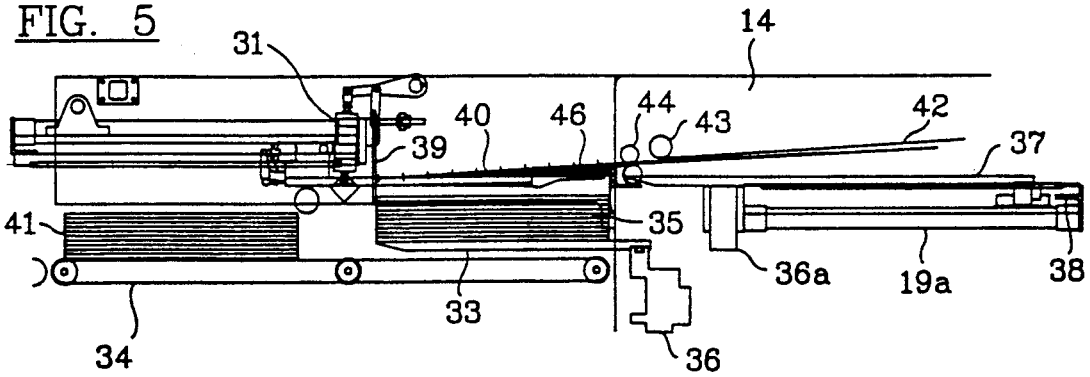
FIG. 5 is similar to FIG. 3, but shows the intermediate interrupt forks at the same elevation as the batch forks and ready to be moved under the partial stack of signatures supported on the batch forks.
Figure 6:
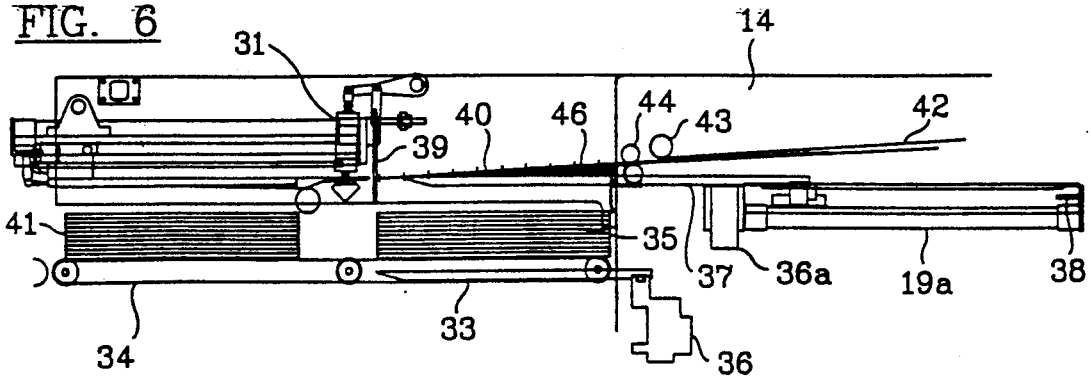
FIG. 6 is similar to FIG. 5, but shows the batch forks retracted, and the partial stack resting on the intermediate interrupt forks.

Shingled signatures 40 leaving the upstream conveyor 42 fall onto the main pile forks 33, which move continuously downward as signatures are added from the top. When the electric photocell counter (not shown) senses there is a complete stack 35, as best seen in FIG. 4 of the drawings, to separate stack 35 from the next shingled signatures 40, the pivoting, integral fingers 24 are caused to depress the last signature 47 to become part of the stack 35, and thereby divert the next incoming signature 45 to the top of batch forks 23, where a partial stack 46 is begun. Meantime, the main pile forks 33 continue to move downwardly until the stack 35 is delivered to the downstream conveyor 34. At this point in time, the optional intermediate interrupt forks 37 have moved in towards the batch forks 23, and under the partial stack 46 to transfer partial stack 46 from the batch forks 23 to the main pile forks 33. When the stack 35 moves downstream on downstream conveyor 34, the main pile forks 33 raise up to receive the partial stack 46 from the interrupt forks 37. As soon as this transfer has been completed, the interrupt forks 37 withdraw to their starting position under upstream conveyor 42, as best seen in FIG. 3, and the cycle is repeated.

Figure 7:
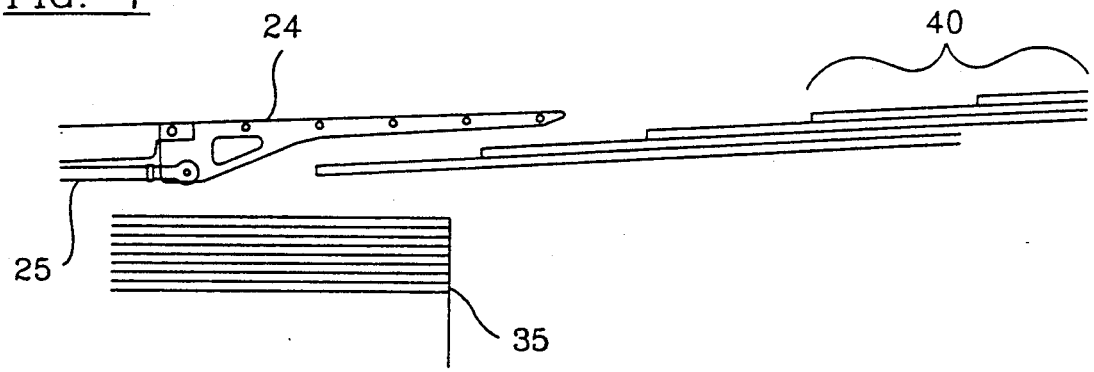
FIG. 7 is a detailed side elevation showing the relative positions of the shingled signatures and the integral, pivoting fingers during the initial stacking cycle.
Figure 8:
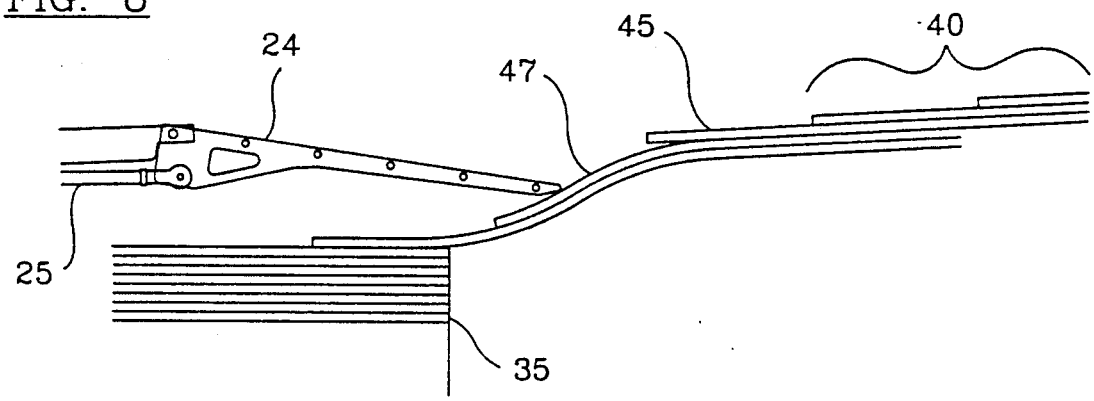
FIG. 8 is similar to FIG. 7, but shows the integral, pivoting fingers depressed against the last signature in the initial stack.
Figure 9:
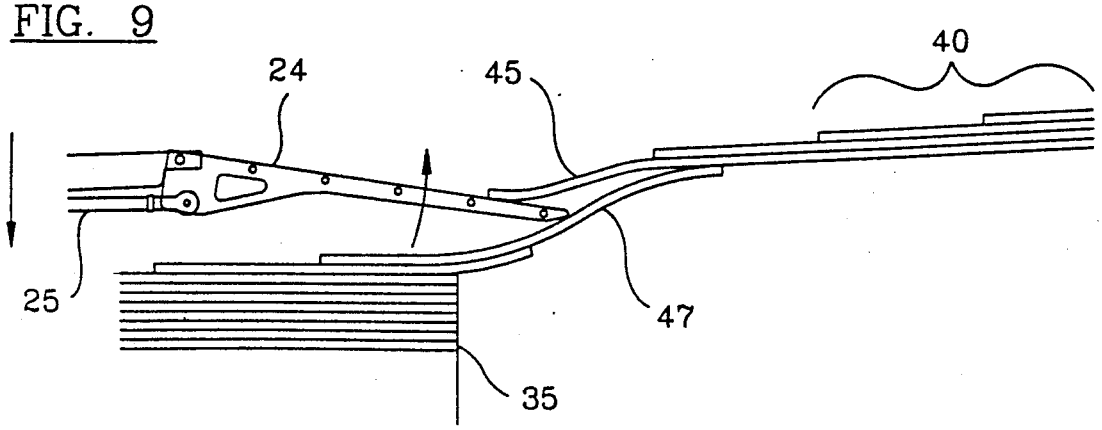
FIG. 9 is similar to FIG. 8, but shows the signatures of the intermediate, partial stack being stacked on the batch forks.

FIGS. 7–9 show in detail the sequence of actions which enable continuous, in-line, high-speed separation of shingled signatures into stacks of predetermined quantities.

In the initial stage shown in FIG. 7, the shingled signatures 40 flow from the downstream end of the upstream conveyor 42 and drop onto the main pile forks 33 to be stacked. When the electric counter sensing means (not shown) senses the last signature 47 of the preset quantity required for a stack 35, the pivoting, integral fingers 24 are caused to depress by actuation of solenoid 30. The fingers 24 cause the first signature 45 and the following shingled signatures 40 to be diverted onto the batch forks 23 to commence a partial stack 46. The cycle continues as described above in connection with FIGS. 3–6.

This invention provides a continuous, in-line high speed batching system for stacking signatures at a rate up to about 1200–1300 feet per minute and higher. The novel features include the integral, pivoting fingers which provide a means for efficiently separating shingled signatures into batches for accurate-count stacking without the need for "gapping", slowing or interrupting the flow of signatures.

We claim:

1. In a paper batching system for separating shingled signatures into stacks comprising:
   - a stationary frame;
   - a conveyor system for continuously conveying a stream of shingled signatures along a generally horizontal path;
   - a plurality of generally horizontally disposed batch forks;
   - a batch carriage slidably supporting the batch forks, said batch carriage being pivotally attached at its downstream end to the stationary frame to enable raising and lowering of the upstream ends of said batch forks simultaneously, or separately from, horizontal extension or retraction of said batch forks; and
   - a plurality of pivoting fingers, each being pivotally attached at its downstream end to one of said batch forks, said pivoting fingers extending generally horizontally in an upstream direction just above the stream of shingled signatures, and being adapted to rapidly press down a predetermined one of the incoming shingled signatures to separate the signature from the subsequent shingled signatures, said batch forks cooperating with the pivoting fingers to receive at least a partial stack of signatures diverted onto the batch forks by the pivoting fingers, whereby said shingled signatures are separated into batches of predetermined quantities.

2. The paper batching system of claim 1, including a rapid response solenoid system responsive to a predetermined count of incoming shingled signatures to cause said movable fingers to rapidly press down on a predetermined one of said incoming shingled signatures to separate the shingled signatures into predetermined batches.

3. The paper batching system of claim 1, including front stop means connected to the stationary frame of said paper batching system for stopping incoming signatures to cause said shingled signatures to form a vertical stack.

4. The paper batching system of claim 2, in which the solenoid system for each batch fork includes a push rod connected at its downstream end to a solenoid, and at its upstream end to a pivoting finger to pivot said finger up or down.

5. The paper batching system of claim 3, including a plurality of horizontally disposed main pile forks for receiving incoming shingled signatures and retaining said signatures in the vertical stack formed by said front stop means.

6. The paper batching system of claim 5, including means for raising and lowering the main pile forks to and from signature receiving position and a stack unloading position.

7. The paper batching system of claim 6, in which the conveyor system includes a downstream conveyor for receiving a complete vertical stack of signatures to convey them from said paper batching system.

8. The paper batching system of claim 7, including means to lower the main pile forks to a horizontal plane below the level of the downstream conveyor to transfer a vertical stack of signatures to the downstream conveyor.

9. The paper batching system of claim 8, including a plurality of intermediate interrupt forks for receiving and holding a partial, vertical stack of signatures from said batch forks while a complete vertical stack of signatures is being transferred from said main pile forks to the downstream conveyor.

10. The paper batching system of claim 9, in which the intermediate interrupt forks include support means disposed on said stationary frame which allows horizontal motion of said interrupt forks to and from a position in vertical alignment with said partial vertical stack of signatures to facilitate transfer of said partial vertical stack to said intermediate interrupt forks and to enable further transfer of said partial vertical stack of signatures to the main pile forks.

* * * * *